United States Patent [19]

Gendron

[11] Patent Number: 4,730,768

[45] Date of Patent: Mar. 15, 1988

[54] REMAILABLE ENVELOPE

[75] Inventor: Wilfred H. Gendron, Wilbraham, Mass.

[73] Assignee: Westvaco Corporation, New York, N.Y.

[21] Appl. No.: 325,020

[22] Filed: Nov. 25, 1981

[51] Int. Cl.[4] ..... B65D 27/06

[52] U.S. Cl. ..... 229/73; 229/71

[58] Field of Search ..... 229/73, 71

[56] References Cited

U.S. PATENT DOCUMENTS

| | | | |
|---|---|---|---|
| 3,558,040 | 1/1971 | Krueger | 229/73 |
| 4,288,028 | 9/1981 | Diaz | 229/73 |
| 4,308,987 | 1/1982 | Solomon | 229/73 |

*Primary Examiner*—Mark J. Thronson
*Assistant Examiner*—David Voorhees

[57] ABSTRACT

A remailable envelope is disclosed which comprises first and second extensions attached to the front and rear panels and first and second closure flaps attached to the first and second extensions. The nominal height of the rear wall is greater than the nominal height of the front wall, however, by selectively folding the envelope panels about the score lines provided for the first and second extensions, and first and second closure flaps, the envelope structure for the remailing can be made smaller than the envelope structure for the first mailing use.

3 Claims, 8 Drawing Figures

REMAILABLE ENVELOPE

BACKGROUND OF INVENTION

The present invention relates to a remailable or two-way envelope adapted to be used after its first mailing to return an enclosure, payment or the like. Such envelopes are particularly advantageous for direct mail solicitation, wherein the return mail flap may be preaddressed and provided with return postage, and for business use in billing customers where the return mail feature promotes a prompt remittance by the customer.

The basic requirements for such an envelope include ease of manufacture on high speed equipment, suitability for use with automatic stuffing and sealing equipment, a relatively uncomplicated means for preparing the envelope for return mail use and flexibility of design for use with preaddressed billing statements, computer cards or address labels. Envelopes which incorporate one or more of the above noted desirable features are known, however the prior art envelopes suffer from a variety of defects. Examples of such prior art two way envelopes include those shown in U.S. Pat. Nos. 3,558,040 and 4,288,028. Nevertheless, although the desired requirements for a two way envelope are known, only the envelope structure disclosed herein provides each of the desirable features necessary to achieve the stated results.

SUMMARY OF INVENTION

It is a general object of the present invention to provide a remailable or two way envelope useful for direct mail solicitation or business use for billing customers.

It is another object of the present invention to provide a remailable envelope adapted for use with automatic stuffing and sealing equipment.

It is a further object of the present invention to provide a two way envelope of simple yet flexible design that is easily prepared for remailing by the first addressee.

It is another object of the present invention to provide a two way envelope having a window through which address information is displayed for the first mailing of the envelope, and which is covered during the remailing to assure integrity of the contents of the envelope at all times.

An additional object of the present invention is to provide an envelope for first mailing of one size and a return mail envelope of slightly smaller size.

These and other objects of the invention are carried out by providing an envelope blank structure comprising front and rear panels, a first extension to the front panel, a second extension to the rear panel and side closure flaps attached either to the front or rear panels. The first extension is attached to the upper edge of the front panel along a perforated line so that it may be detached from the envelope for the remailing use. The first extension also includes an integral first closure flap defined by a score line about which the closure flap is folded to close the envelope for the first mailing use. The second extension includes an integral second closure flap and an intermediate panel separated from one another by paired fold lines. The second extension is attached to the upper edge of the rear panel along the same score line that is used to fold the second closure flap over for remailing. Meanwhile the remailing score line in the second extension flap is used for preparing the envelope for the first mailing use.

In its preferred embodiment, the envelope blank is provided with a window in its front panel to enable the sender in the first instance to insert an item on which the address information of the addressee is printed for display through the window. In such case, the second closure flap is made larger than the first closure flap so that it will cover the window for remailing. Furthermore, by making the nominal size of the rear panel larger than the nominal size of the front panel, and selectively folding the envelope panels about the score lines provided in the first and second extension, the envelope structure for the first mailing may be made larger than the envelope structure for the remailing use. This is a particularly desirable feature of the envelope of the present invention since in most cases the materials included with the first mailing may be larger than the expected return enclosure.

Further objects, features and advantages of the present invention will become apparent from a consideration of the following description taken in connection with the appended claims and drawing.

DETAILED DESCRIPTION

Figure 1:
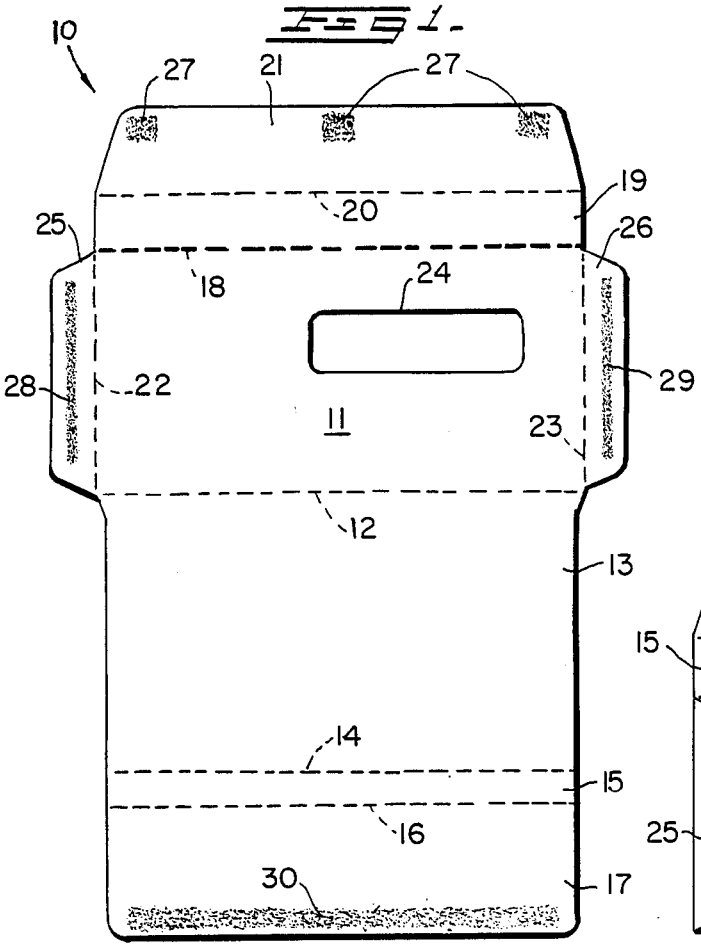
FIG. 1 is a plan view of a preferred embodiment of the blank used to make the envelope of the present invention.

Referring to the drawing, the remailable envelope of the present invention is formed from a blank 10 as shown in FIG. 1. The blank has an inside surface and outside surface (inside surface shown in FIG. 1), and includes a front panel 11 having side, top and bottom edges and a rear panel 13 having side, top and bottom edges. The bottom edges of the front panel 11 and rear panel 13 are joined together along a first score line 12, and as shown, the nominal height of rear panel 13 is greater than the nominal height of the front panel 11.

The top edge of front panel 11 is defined by a perforated line 18 where there is attached a first extension comprising panel 19 and first closure flap 21 separated from one another by score line 20. Meanwhile, the top edge of rear panel 13 is defined by a score line 14 where there is attached a second extension comprising panel 15 and second closure flap 17 separated from one another by a score line 16. The first closure flap 21 is applied with spots of adhesive 27 for use in the first mailing and the second closure flap 17 is applied with adhesive 30 for use in remailing. In the instance where the front panel 11 includes a window 24, the second closure flap 17 must be larger than the first closure flap 21 in order that the former might cover the window for remailing. Finally, the blank 10 includes side closure flap 25 and 26 connected to the front panel 11 along scored lines 22 and 23 respectively. These flaps include adhesive applications at 28,29 for sealing the ends of the envelope.

Figure 2:
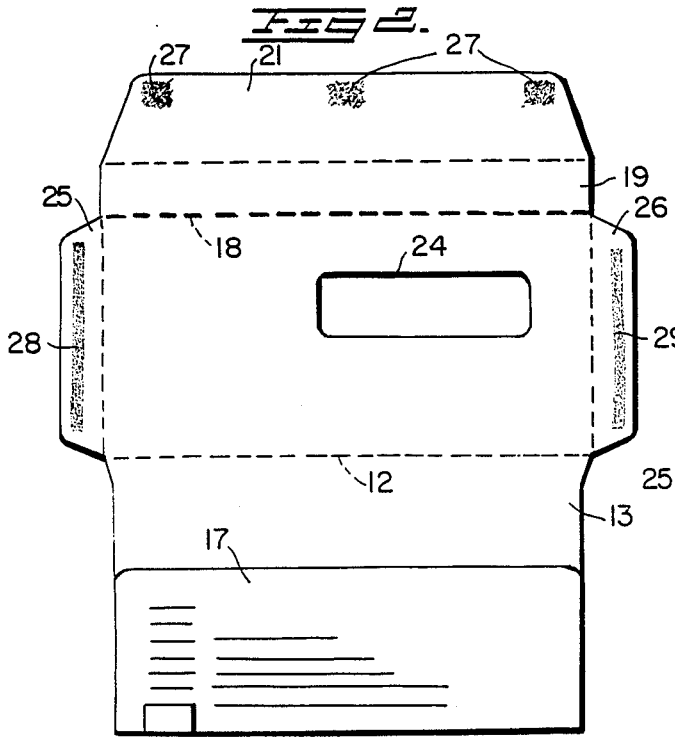
FIG. 2 shows the first folding step in the assembly of the envelope from the blank of FIG. 1.

FIG. 2 shows the first step in fabricating the envelope of the present invention. For this purpose, the second closure flap 17 is folded over about score line 16. In this condition, the closure flap 17 may be seen to be imprinted with an appropriate return address, and where desired, prepaid postage for remailing. This folding step serves to position the second closure flap 17 inside the envelope pocket since the next folding step involves a fold of both the rear panel 13 and closure flap 17 about score line 12. At this point, the side closure flaps 25,26 are folded over about their score lines 22,23 and adhered to the rear panel 13 of the envelope.

Figure 3:
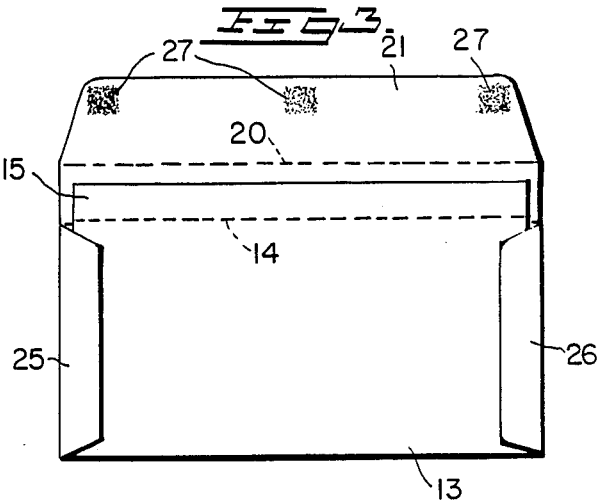
FIG. 3 shows the envelope in its final state of assembly and ready for insertion for first mailing.
Figure 4:
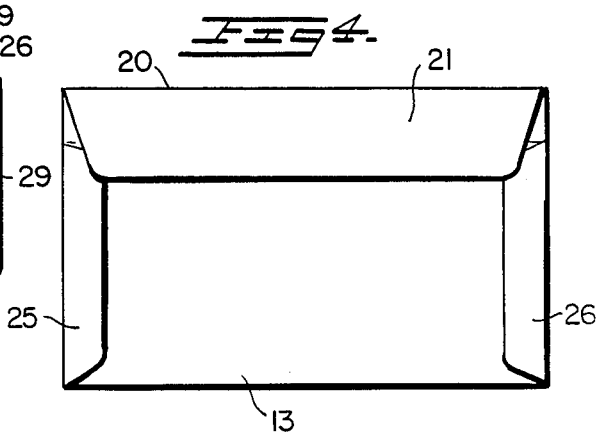
FIG. 4 shows the sealed envelope as received by the first addressee.

FIG. 3 illustrates the completed envelope ready for insertion and sealing on high speed equipment. Note that the nominal height of the rear panel 13 as measured by the score line 14 is slightly higher than the nominal height of front wall 11 as measured by the score line 18. However, in the condition shown in FIG. 3, the actual height of rear wall 13 includes the second extension panel 15. This panel extends well above the height of the side closure flap 25,26 to give the envelope a decided advantage in filling on high speed equipment. The advantage is obtained because the throat of the envelope as defined by the first closure flap 21 and first extension 19 and the rear wall as extended by panel 15 allows the envelope to be opened wide for easy insertion. In addition, because there is only one flap (flap 17) folded inside the envelope, and because of the reduced height of the side closure flaps 25,26 there are no obstructions in the envelope to interfere with the stuffing process. After the envelope is stuffed, it is sealed closed as shown in FIG. 4.

Figure 5:
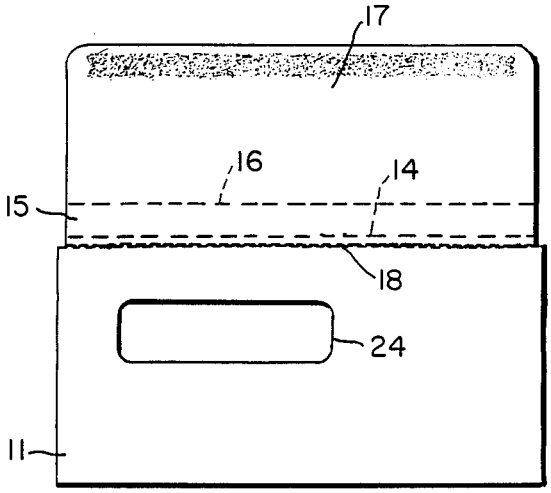
FIG. 5 shows the envelope in condition for remailing.
Figure 6:
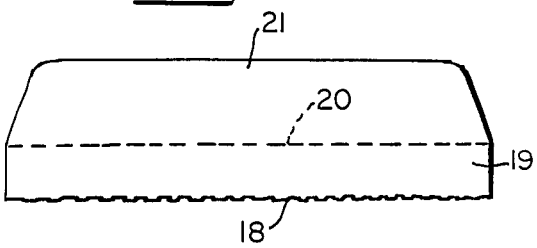
FIG. 6 shows the detached first closure flap.
Figure 7:
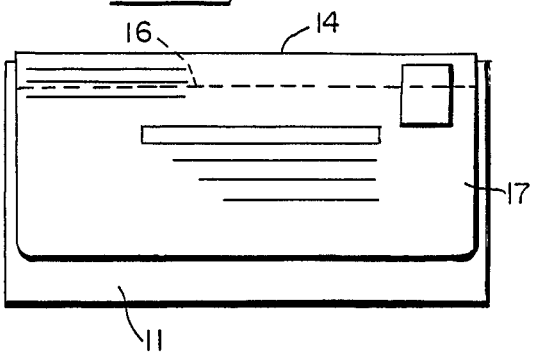
FIG. 7 shows the envelope sealed for remailing use.

When the first named addressee receives the envelope and desires to prepare it for remailing, the first closure flap 17 and first extension 19 are preferably removed along perforated line 18 as shown in FIGS. 5 and 6. At that time, the second closure flap 17 can be pulled from within the envelope and used to reseal the envelope for the remailing by folding the flap 17 and second extension 15 over about score line 14. As shown in FIG. 7, since the second closure flap 17 is larger than the first closure flap, the window 24 is covered for remailing. Moreover, because the nominal height of front panel 11 is lower than the nominal height of rear panel 13, the envelope for remailing is smaller than the envelope configuration for first mailing, and the second closure flap is easily folded over for resealing. This is a desirable feature since in most instances, the returned contents are of smaller size than the first mailed contents.

Figure 8:
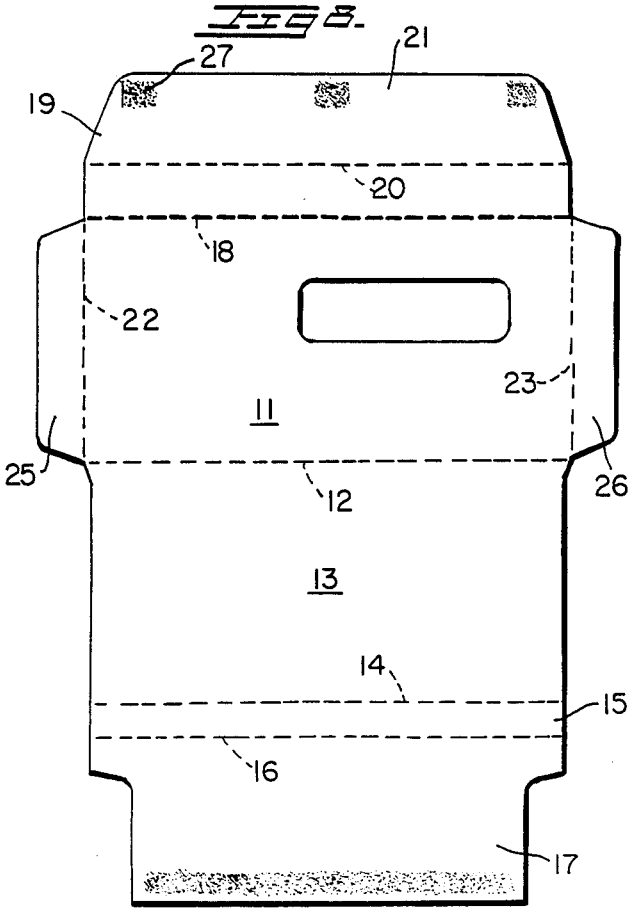
FIG. 8 shows a modified version of the envelope blank for the present invention.

In the embodiment shown in FIG. 8, the envelope functions in the same manner as described above, except that the side closure flaps are adhered to the inside of the rear panel rather than the outside of the rear panel.

Various other modifications may be made in the envelope structure as desired within the scope of the appended claims. For instance, where desired, the first closure flap could simply be folded inside the envelope for the remailing use. However, in any event, it is anticipated that the envelope will be printed with appropriate instructions to explain how it should be opened and prepared for return use.

I claim:

1. A remailable envelope formed from one piece blank having inner and outer surfaces wherein the envelope structure for remailing is smaller than the envelope structure for first mailing comprising:

(a) a front panel having side, top and bottom edges;

(b) a rear panel having side, top and bottom edges;

(c) the front and rear panels being joined together at their bottom edges about a first fold line and arranged so that their inner surfaces lie in opposed relation when the envelope is formed;

(d) a first extension panel attached to the top edge of said front panel along a perforated line;

(e) a second extension panel attached to the top edge of said rear panel along a second fold line;

(f) the nominal height of said rear panel between said first and second fold lines being greater than the nominal height of said front panel between the first fold line and the perforated line;

(g) a first closure flap foldably attached to the first extension panel along a third fold line;

(h) a second closure flap foldably attached to the second extension panel along a fourth fold line and folded inside said envelope about the fourth fold line for first mailing; and, (i) a pair of side closure flaps foldably attached to the side edges of the front panel and adhered to a surface of said rear panel to maintain the inner surfaces of the front and rear panels in opposed relation wherein said envelope is prepared for first mailing by folding only the first closure flap over about the third fold line before it is sealed to the outer surface of said rear panel, and is prepared for remailing by removing the first closure flap and first extension panel along the perforated line provided therefor, and then closed, after extracting the second closure flap from the inside thereof, by folding the second closure flap and second extension panel over about the second fold line before the second closure flap is sealed to the outer surface of the front panel to provide a remailing envelope structure that is smaller in height than the first mailing structure.

2. The envelope of claim 1 wherein the front panel contains a window.

3. The envelope of claim 2 wherein the second closure flap is larger than the first closure flap.

* * * * *